US006419132B1

(12) United States Patent
Reed et al.

(10) Patent No.: US 6,419,132 B1
(45) Date of Patent: Jul. 16, 2002

(54) BACKPACK WITH DEPLOYABLE ARMOR

(76) Inventors: David K. Reed, 40552 N. Territory Trail, Anthem, AZ (US) 85086; David Perkins, 19406 Van Aiken Blvd., Shaker Heights, OH (US) 44122

( * ) Notice: Subject to any disclaimer, the term of this patent is extended or adjusted under 35 U.S.C. 154(b) by 0 days.

(21) Appl. No.: 09/777,811

(22) Filed: Feb. 6, 2001

(51) Int. Cl.[7] ..... A45F 4/02

(52) U.S. Cl. ..... 224/153; 224/628; 224/632; 109/49.5; 2/2.5; 2/463

(58) Field of Search ..... 224/153, 577, 224/586, 628, 631, 632; 109/49.5; 2/463, 2.5

(56) References Cited

U.S. PATENT DOCUMENTS 4,266,297 A * 5/1981 Atkins ..... 2/2.5
4,389,735 A * 6/1983 McLaughlin ..... 2/94
4,475,247 A * 10/1984 Lee ..... 2/2.5
4,507,802 A * 4/1985 Small ..... 2/2.5
4,793,534 A 12/1988 Berry
4,830,245 A 5/1989 Arakaki
5,431,318 A * 7/1995 Garcia ..... 2/2.5
5,644,792 A 7/1997 Tishler et al.
5,797,140 A * 8/1998 Davis et al. ..... 2/2.5
5,829,653 A * 11/1998 Kaiser ..... 2/2.5
6,161,738 A * 12/2000 Norris ..... 109/49.5
6,185,738 B1 * 2/2001 Sidebottom ..... 2/102

* cited by examiner

*Primary Examiner*—Stephen K. Cronin
(74) *Attorney, Agent, or Firm*—Parsons & Goltry; Michael W. Goltry; Robert A. Parsons

(57) ABSTRACT

A backpack engagable so as to be worn and including an attached covering having load-bearing armor and mounted for movement between a stored condition of the armor toward the backpack and a deployed condition of the armor away from and opposing the backpack.

22 Claims, 4 Drawing Sheets

FIG. 4
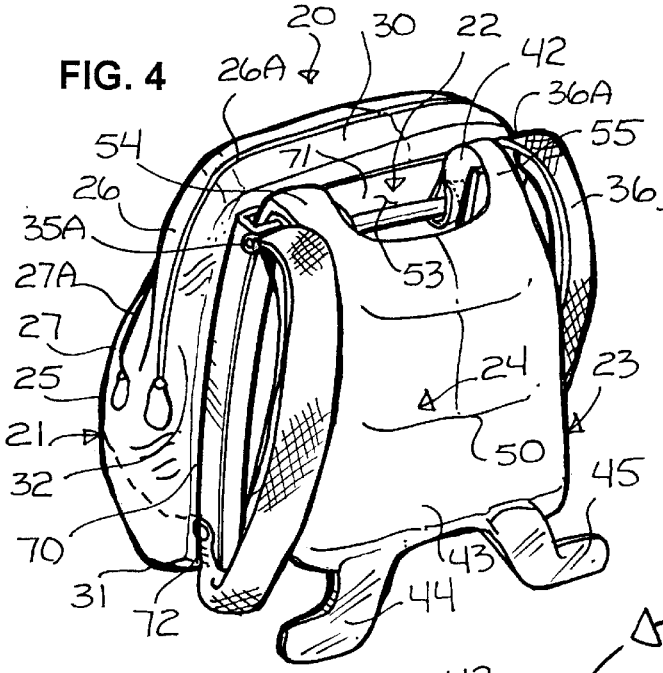
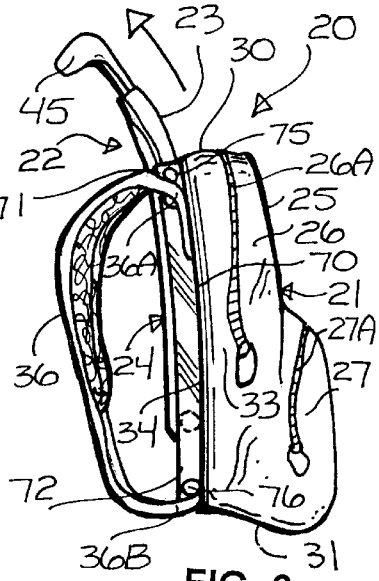
FIG. 6
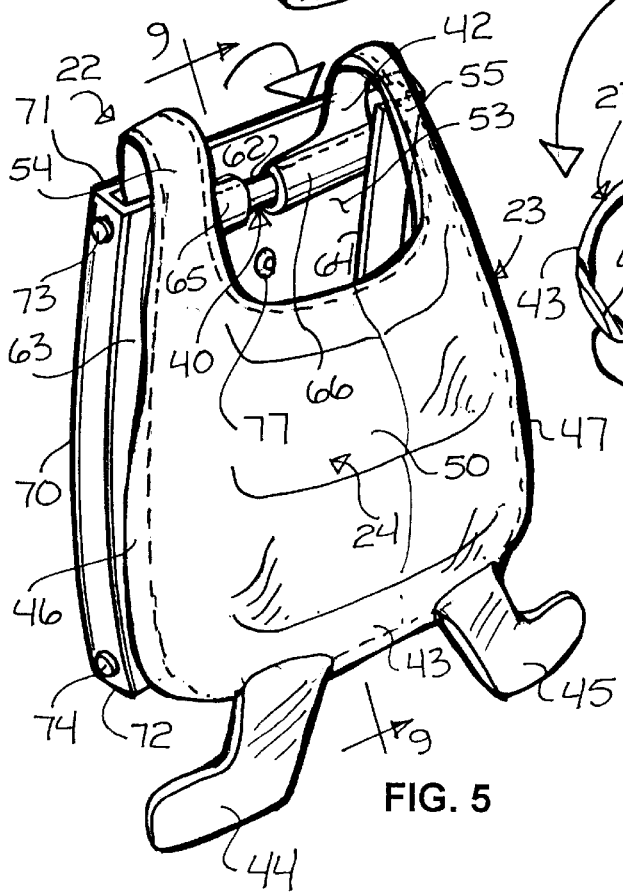
FIG. 5
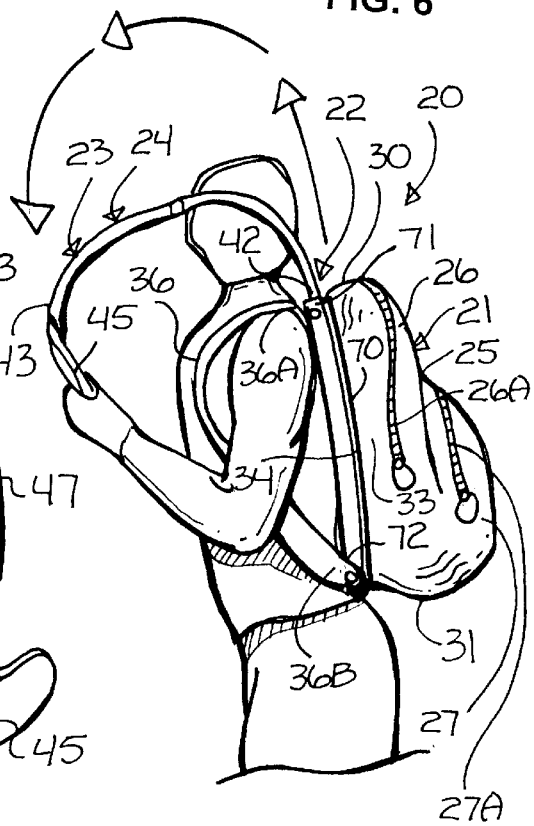
FIG. 7

BACKPACK WITH DEPLOYABLE ARMOR

FIELD OF THE INVENTION

This invention relates to protective devices and to backpacks and to load-bearing body armor and shielding.

BACKGROUND OF THE INVENTION

The world has become a place where our children are no longer safe at their schools. It is now not a question of whether gun violence will occur at our children's schools but a presumption that that it will and a question of what is to be done about it. For many schools, students cannot attend gym class or wood shop without first passing through a metal detector. Given all the security measures employed in most schools throughout the world, students and parents still remain in a state of unrest at the possibility of gun violence.

Solving the problem of gun violence and for all needless violence for that matter must start within the home, with parents showing their children love, understanding, compassion and attention, and instilling into their children lasting values and the virtue of respecting others. Outside of this, there is little available for helping children protect themselves against the threat of gun violence other than more violence.

Given that many students use backpacks to transport their books and personal effects to and from school, there is a need for an improved backpack having attached load-bearing armor that is movable between stored and deployed conditions for providing ballistic protection for the majority of the upper torso including the belly and chest.

SUMMARY OF THE INVENTION

The above problems and others are at least partially solved and the above purposes and others realized in new and improved apparatus comprising a backpack engagable so as to be worn and an attached covering having load-bearing armor. The covering is mounted for reciprocal movement between a stored condition of the armor toward the backpack and a deployed condition of the armor away from and opposing the backpack. The backpack includes a substantial body shell having upper and lower extremities and opposing side extremities and opposing shoulder straps having upper ends attached proximate the upper extremity of the shell and lower ends attached proximate the lower extremity of the shell. The covering may further be mounted for movement between the stored and deployed conditions of the armor in opposition to the upper extremity of the shell or in opposition to one of the side extremities of the shell. The backpack is preferably equipped with a fixed load bearing base for providing dedicated ballistic protection for a wearer's back when the backpack is worn. The covering may be mounted to this base for reciprocal movement if so desired.

Consistent with the foregoing, the invention also contemplates associated methods.

BRIEF DESCRIPTION OF THE DRAWINGS

Referring to the drawings:

FIG. 4 is a. perspective view of the apparatus of FIG. 1 showing the covering as it would appear in the deployed condition;

FIG. 5 is a perspective view of the device of FIG. 1;

FIG. 6 is a view very similar to the view of FIG. 2 and showing the covering as it would appear partially deployed;

FIG. 7 is a view generally like that of FIG. 3 and showing the covering as it would appear being deployed by the user;

DETAILED DESCRIPTION OF A PREFERRED EMBODIMENT

The present invention provides new and improved apparatus for providing children with ballistic protection. The invention is concerned generally with the novel combination of a backpack and. deployable load-bearing armor, and a novel device having deployable load-bearing armor for use with a backpack. In the interest of clarity of the ensuing discussion of the invention, §A sets forth a general OVERVIEW of the apparatus of the invention §B presents a detailed account of the structure and function of a BACKPACK of the invention, §C presents a detailed account of the structure and function of a DEVICE of the invention having deployable load-bearing. armor, and §D presents a brief discussion of an ALTERNATE EMBODIMENT of the invention followed by a CONCLUSION in §E.

§A. Overview

Figures 1, 2, 3:
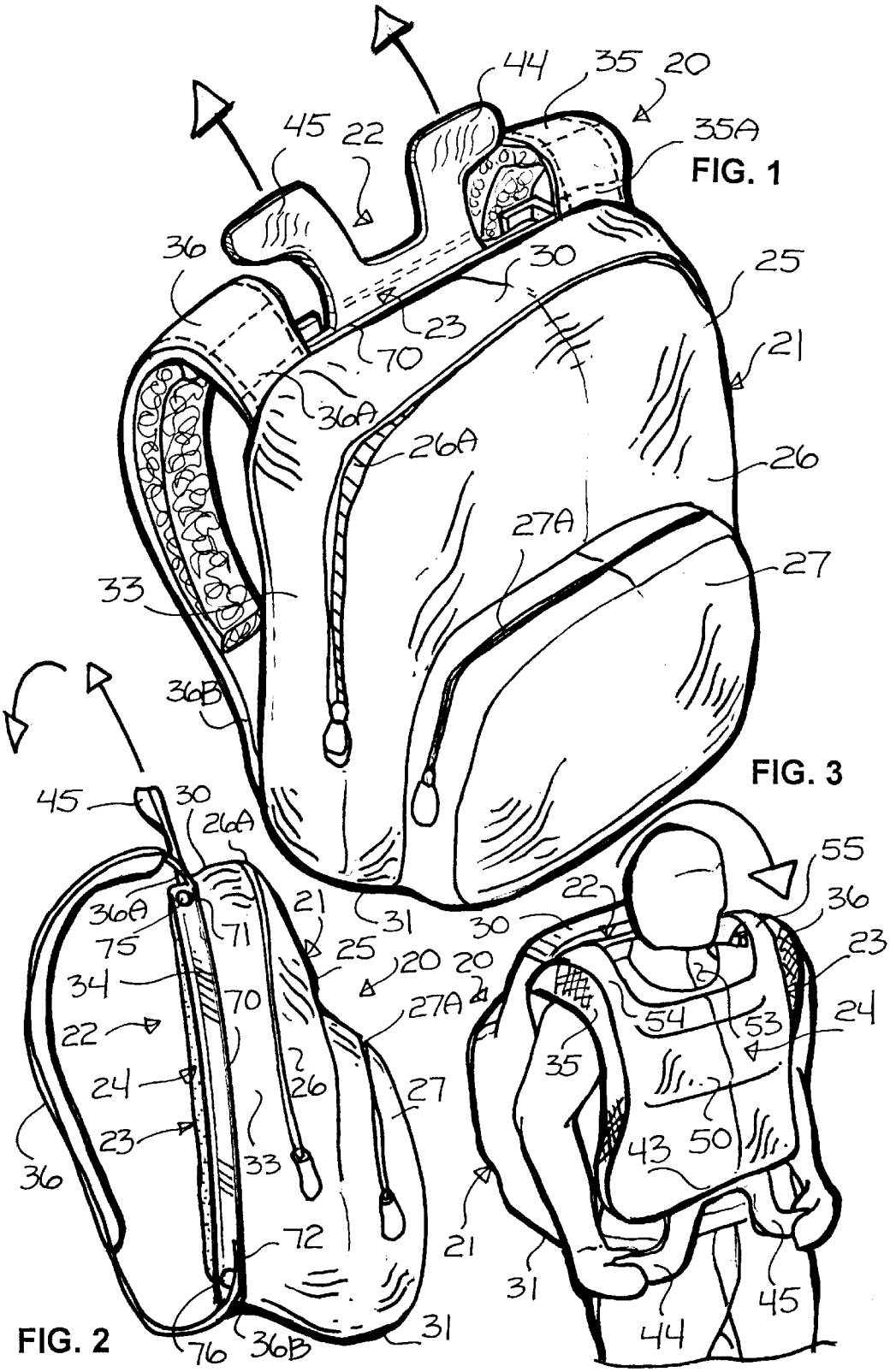
FIG. 1 is a perspective view of apparatus comprising a backpack engagable so as to be worn and an attached device including a covering having load-bearing armor and mounted for movement between a stored condition toward the backpack and a deployed condition extending away from and opposing the backpack, in accordance with the invention.
FIG. 2 is a side view of the apparatus of FIG. 1.
FIG. 3 is a perspective view showing the apparatus of FIG. 1 as it would appear being worn by a user and the covering as it would appear in the deployed condition with the armor overlying the chest and belly of the user.

Referring to the drawings, FIGS. 1, 2 and 4 illustrate various views of apparatus 20 comprising a backpack 21 engagable so as to be worn as depicted generally in FIGS. 3 and 7. Attached to backpack 21 is a device 22 that includes a covering 23 having load-bearing armor denoted generally by the reference numeral 24 (not shown in FIG. 1). Covering 23 is mounted for movement between stored and deployed conditions. In the stored condition, armor 24 is located at backpack 21. in the deployed condition, armor 24 extends away from and opposes backpack 21 as shown in FIG. 4. Apparatus 20 is useful for accommodating books and various personal effects, and armor 24 is attached and arranged so that it is not only substantially concealed in its stored condition but also easily and efficiently deployable and positionable for overlying the majority of the wearer's upper torso including the chest and belly for providing ballistic protection for the chest and belly. Covering 23 may be positioned at selected locations between the stored and deployed conditions for providing ballistic protection for other areas of the body including the head and neck.

§B. Backpack

Figure 8:
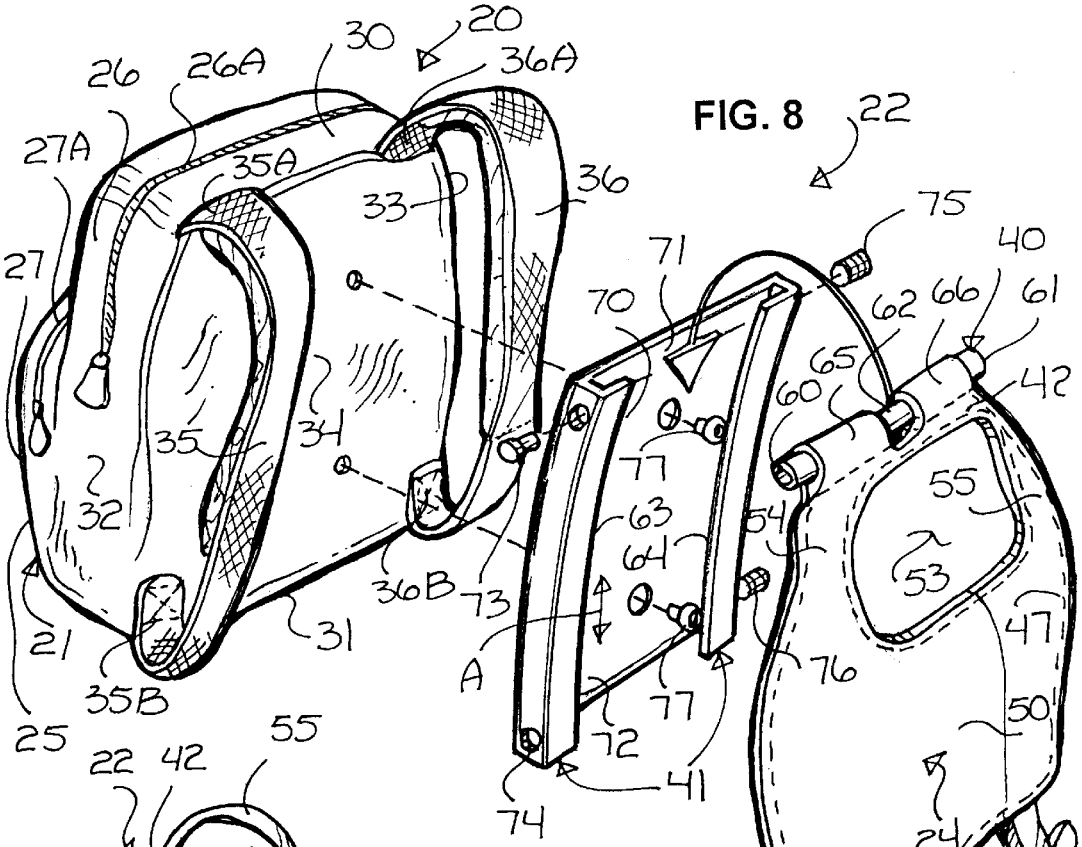
FIG. 8 is an exploded perspective view of the apparatus of FIG. 1.

With continuing reference to FIGS. 1, 2 and 4, and additional reference to FIGS. 6, 7 and 8, backpack 21 is constructed and arranged specifically as a type commonly used by students for carrying their books and personal effects to and from school and other places. Backpack 21 is constructed of canvass, nylon or the like, and is comprised of a substantial body shell 25 that includes main and minor compartments 26 and 27 each having zippered closures 26A and 27A, respectively, and other flap or closure forms may be employed. Backpack 21 may be constructed and arranged with only one compartment or any number of compartments, and it may also be equipped with any number pockets or receptacles constructed and arranged for accommodating pens, pencils or any number of other types of personal effects. Although backpack 21 may be mounted to or otherwise incorporate a light frame, backpack 21 does not include one in this specific embodiment.

With specific attention directed to FIG. 8, shell 25 includes upper and lower extremities 30 and 31, opposing side extremities 32 and 33, a major back-facing portion 34 and attached shoulder straps 35 and 36. Straps 35 and 36 are constructed and arranged to overly and engage the shoulders of a wearer or user, which is how backpack 21, like most backpacks, is to be worn. Back-facing portion 34 is referred to as such because when backpack 21 is worn it faces and overlies the back of the wearer. Straps 35 and 36 oppose one another and back-facing portion 34, and respectively include upper ends 35A and 36A attached to shell 25 proximate upper extremity 30 and lower ends 35B and 36B attached to shell 25 proximate lower extremity 31. The general structural and functional characteristics of backpack as discussed in §B comport generally with many conventional backpacks of like structure and design. The various components of backpack 21 are assembled with stitching and the nature of other conventional features of backpack 21 not discussed will readily occur to the skilled artisan.

§C. Device

Regarding FIG. 8, device 22 is comprised of covering 23, an engagement element 40 and a complemental engagement element 41. The term "element" as it is used in conjunction with engagement element 40 and with complemental engagement element 41 does not necessarily denote a single object or thing, but may otherwise comprise a number of objects or things that are either connected to one another or mounted in such a way that they cooperate together in a specific fashion toward a desired functional end.

Covering 23 is overall substantially flat and includes substantial proximal and distal extremities 42 and 43 and side extremities 46 and 47. Handles 44 and 45 are attached to and extend away from distal extremity 43, and engagement element 40 is carried by proximal extremity 42. Looking momentarily to FIG. 9, covering 23 is formed substantially of opposing major portions 50 and 51 and a load-bearing portion, panel or shield 52, which provides ballistic protection. Different degrees of ballistic protection are provided by armor panels made of different thickness, materials, weight and cost, each grade of armor being suited to provide ballistic protection of a specified degree. Shield 52 may therefore be of any suitable grade for providing a desired degree of ballistic protection.

Portions 50 and 51 and handles 44 and 45 are preferably constructed of the same material, namely, a substantial fabric such as canvas and/or nylon or the like and this is preferred, and yet they may be of different materials, whether substantially soft or pliant or more rigid or stiff in character. Portions 50 and 51 are joined at or otherwise proximate their free edges with stitching and/or gluing or in any other suitable fashion and capture and encase shield 52 therebetween. Other free edges of portions 50 and 51 are joined together and define an opening 53 located toward proximal extremity 42 as shown in FIG. 8. Narrowed portions or straps 54 and 55 are generally defined on either side of opening 53 as substantially shown, and portions 50 and 51 and shield 52 cooperate together and define armor 24, which comprises the majority of covering 23 substantially from opening 53 to distal extremity 43. In this specific embodiment, portions 50 and 51 extend between and define proximal and distal extremities 42 and 43 and side extremities 46 and 47.

Portions 50 and 51 may each be part of a single piece of cut material that is folded over and upon itself at either the proximal extremity 42 or the distal extremity 43 so as to encase shield 52 and then joined together at or otherwise proximate formed free edges thereof as substantially disclosed. Covering 23 and its various parts including shield 52 may also assembled from a collection of individual parts or pieces of material or types of materials whether the same or different, and shield 52 need not necessarily be encased but may be exposed either partially or substantially in its entirety. In this vein, various pieces or parts may be assembled and fastened together with stitching, rivets, glue, etc.

In the preferred embodiment shown in FIG. 8, engagement element 40 comprises opposing free ends 60 and 61 of an elongate member 62, and complemental engagement element 41 comprises opposing tracks 63 and 64. Elongate member 62 is substantially rigid and so is formed of rigid plastic, metal, metal composite or any other suitable rigid material or combination of materials, and is held by substantial loops 65 and 66, which encircle member 62. Loops 65 and 66 are located at proximal extremity 42, and only one may be used or any other desired number. Elongate member 62 may be fastened to proximal extremity 42 in other ways such as with rivets or screws, male and female engagement couplings, glue, stitching, etc.

Tracks 63 and 64 oppose and face one another, are substantially coextensive with and parallel to one another and are supported by a base 70. Base 70 is overall substantially flat and includes opposing major surfaces or faces and upper and lower extremities 71 and 72. Tracks 63 and 64 extend substantially from upper extremity 71 to lower extremity 72 on either side of base 70. In this embodiment, tracks 63 and 64 are considered part of base 70. Base 70 is preferably constructed of a load-bearing material like that of shield 52, and yet it may be constructed of plastic, light metal or metal composite or any other rigid or substantially rigid material or combination of materials. Base 70 may be integrally formed or constructed and arranged from a variety of separate parts.

Figure 9:
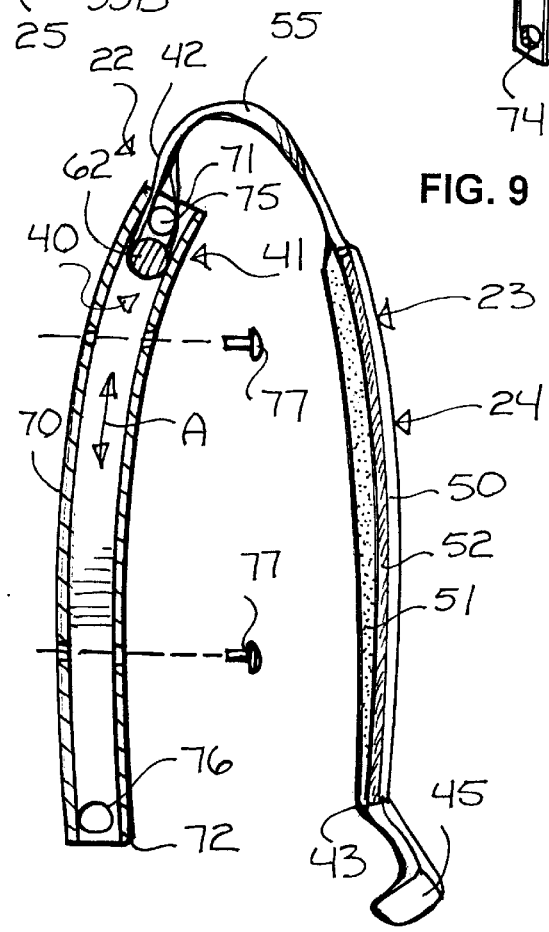
FIG. 9 is a sectional view taken along line 9—9 of FIG. 5.

Ends 60 and 61 each extend into and engage tracks 63 and 64, respectively, and so elongate member 62 extends into and between and is held by tracks 63 and 64, and this structural engagement is depicted generally in FIGS. 5 and 9. Ends 60 and 61 and tracks 63 and 64 are constructed and arranged for reciprocating movement, which allows elongate member 62 to move within tracks 63 and reciprocate between upper and lower extremities 71 and 72 of base 70 as indicated generally by the double arrowed line A, which is depicted in FIGS. 8 and 9. As substantially shown in FIG. 8, stops 73 and 74 extend into track 63 proximate upper extremity 71 and lower extremity 72 of base 70, respectively, and stops 75 and 76 extend into track 64 proximate upper extremity 71 and lower extremity 72 of base 70, respectively. Stops 73, 74, 75 and 76 cooperate together and contain elongate member 62 within tracks 63 and 64 and prevent elongate member 62 from becoming disconnected from base 70.

In accordance with the invention, base 70 is made to be coupled or otherwise fixed to backpack 21 and, more particularly, to back-facing portion 34 with fasteners 77, and FIGS. 2, 4 and 6 substantially illustrate base 70 as it would appear so attached. Because base 70 is preferably constructed of a load-bearing material like that of shield 52, it provides fixed ballistic protection for the wearer's back when backpack 21 is worn and, therefore, comprises a fixed load-bearing armor of backpack 21. Because tracks 63 and 64 need not be attached to base 70, base 70 may be attached to backpack as a separate component for providing ballistic protection or for otherwise functioning as a fixed load-bearing armor for backpack 21. Any number of fasteners 77 may be employed, and they may comprise rivets, screws or any other suitable mechanical fastener and even stitching and gluing. So attached to back-facing portion 34 in accordance with the present embodiment, upper extremity 71 of base 70 is directed toward upper extremity 30 of backpack 21 and lower extremity 72 of base 70 is directed toward lower extremity 31 of backpack 21.

When elongate member 62 is located at lower extremity 72 of base 70, covering 23 is considered in its stored condition toward base 70 as best shown in FIGS. 1 and 2 and handles 44 and 45 are exposed and extend away from upper extremity 71 of base 70 between ends 35A and 36A of straps 35 and 36. In the stored condition, armor 24 is located at base 70 and otherwise at backpack 21 and more particularly opposes and is substantially parallel to back-facing portion 34 and edges 46 and 47 extend into tracks 63 and 64, which helps to contain covering 23 in its stored condition. When elongate member 62 is located at upper extremity 71 of base 70, covering 23 is considered in its deployed condition extending away from base 70 as best shown in FIGS. 4 and 5. In the deployed condition, armor 24 extends away from and opposes base 70 and back-facing portion 34. Tracks 63 and 64 may be separate components not supported by a common base and otherwise attached to backpack 21 in opposing and spaced apart relation if so desired.

With backpack 21 and device 22 assembled together as disclosed, backpack 21 may be worn as substantially shown in FIGS. 3 and 7 with covering 23 in its stored condition. When covering 23 is in its stored condition, backpack 21 is comfortable to wear in accordance with normal use. When confronted with a threat of ballistic force, the wearer may reach up with his hands and take up handles 44 and 45. With a firm grip on handles 44 and 45, the wearer may then deploy covering 23 by forcing it upwardly over his head until it is substantially free from base 70. At this point, the wearer may bring covering 23 downwardly as generally depicted in FIG. 7 so as to locate armor 24 over the majority of the chest and belly as shown in FIG. 3, which provides ballistic protection for the majority of the wearer's chest and belly. Opening 53 accommodates the wearer's head. Covering 23 may be moved from its deployed condition to its stored condition by reversing this operation. Covering 23 is disclosed as movable between the stored and deployed condition in opposition to upper extremity 30 of backpack 21, and yet it may be mounted for reciprocal movement in opposition one of side. extremities 32 and 33. As previously mentioned in §A, covering 23 may be positioned at selected locations between the stored and deployed conditions for providing ballistic protection for other areas of the body including the head and neck.

§D. Alternate Embodiment

Figure 10:
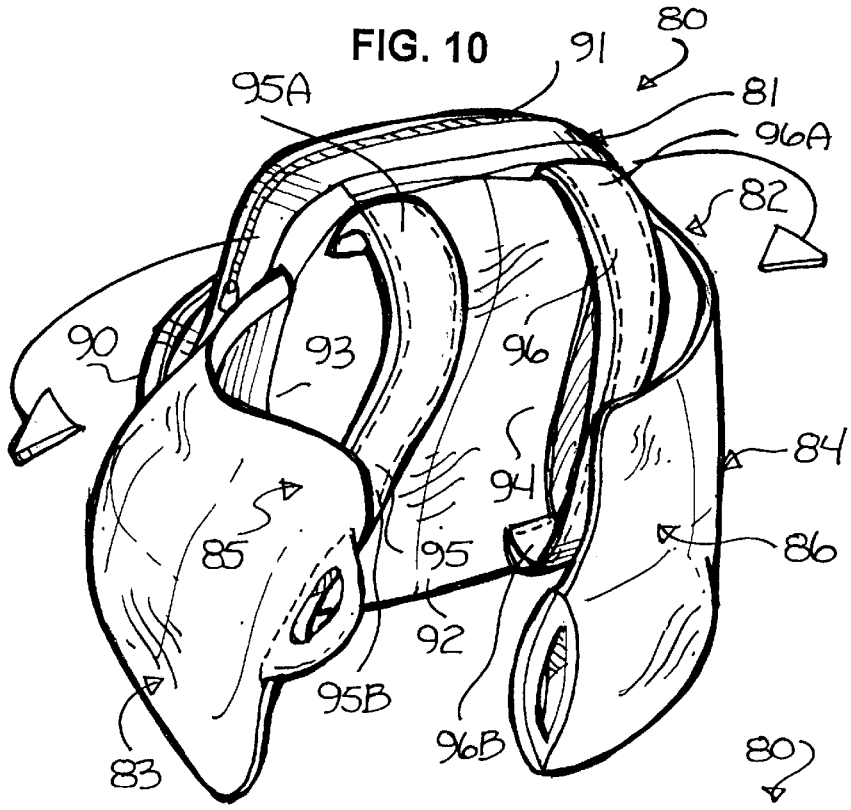
FIG. 10 is a perspective view of apparatus comprising a backpack engagable so as to be worn and an attached device including coverings each having load-bearing armor and mounted for movement between stored and deployed conditions, in accordance with another embodiment of the invention.
Figure 11:
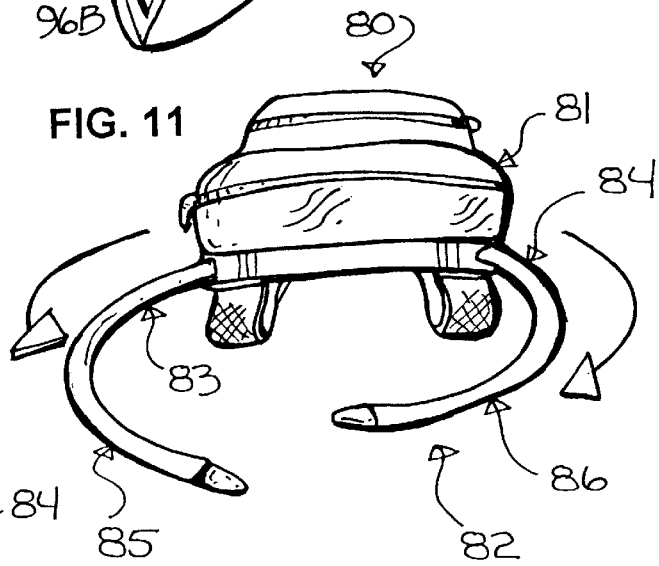
FIG. 11 is a top view of the apparatus of FIG. 1 showing the coverings as they would each appear in the deployed condition.
Figure 12:
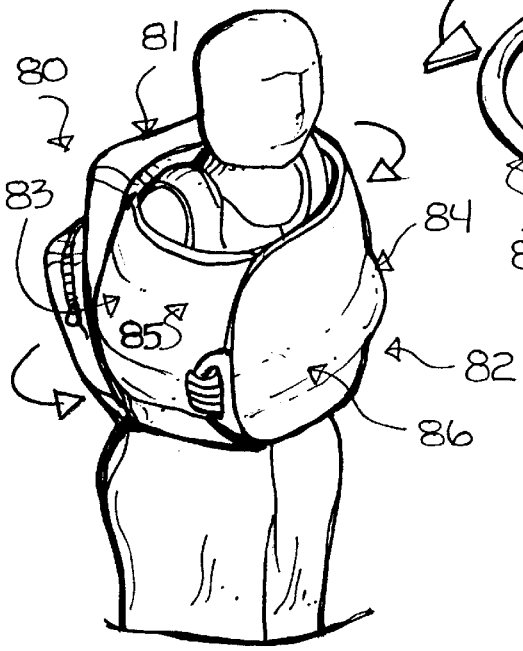
FIG. 12 is a perspective view showing the apparatus of FIG. 10 as it would appear being worn by a user and the coverings as they would each appear in the deployed condition with the armors overlying the chest, belly and arms of the user.

Turning now to FIGS. 10–12, shown is an alternate embodiment of apparatus 80 comprising a backpack 81 engagable so as to be worn and an attached device 82 including coverings 83 and 84 each having load-bearing armor 85 and 86, respectively, and mounted for movement between stored and deployed conditions, in accordance with another embodiment of the invention. Regarding FIG. 10 and like backpack 21, backpack 81 includes a substantial body shell 90 having upper and lower extremities 91 and 92, opposing side extremities 93 and 94, and shoulder straps 95 and 96, which respectively have upper ends 95A and 96A attached to shell 90 proximate upper extremity 91 and lower ends 95B and 96B attached to shell 90 proximate lower extremity 92. The various structural features of backpack 81 are substantially identical to that of backpack 21, and the structural details of device 82 are substantially identical to that of device 22, and so further and more specific detailed thereof will not be again addressed.

The purpose of illustrating apparatus 80 is to show that the device of the invention may incorporate more than one covering, namely, two in this present example, and that deployment of coverings may be made in opposition to side extremities 93 and 94. With this arrangement, the wearer may take up handles of one or both of coverings 83 and 84 on either side of shell 90 and then deploy one or both of them for providing ballistic protection for not only the majority of his chest and belly, but also his arms as substantially shown in FIG. 12. In FIGS. 10–12, the base or base structure to which coverings 83 and 84 are mounted for reciprocal movement is not shown as it is encased by the back-facing portion of backpack 81.

§E. Conclusion

In summary, the present invention provides a novel backpack construction having deployable load-bearing armor and a novel device having deployable load-bearing armor that is to be used in combination with a backpack. The invention has been described above with reference to one or more preferred embodiments. However, those skilled in the art will recognize that changes and modifications, whether known in the art or novel, may be made to the described embodiments without departing from the nature and scope of the invention. For instance, engagement and complemental engagement pairs or elements may be reversed. Also, it is preferred that the device of the instant invention be carried at the back-facing portion of a backpack. However, the device of the invention may be mounted to a backpack at any location along the substantial body shell thereof, whether exposed or substantially encased, that makes it suitable for allowing load-bearing armor to be moved by the wearer between stored and deployed conditions. If the device of the invention is substantially encased by portions of the backpack, such as the back-facing portion, one or more openings may be provided for allowing the covering or coverings to be moved reciprocally therethrough. Also, various mechanical assemblies may be employed for mounting the covering of the invention for reciprocal movement between the stored and deployed conditions including, but not limited to, wheeled engagement assemblies, complemental male and female track or reciprocating assemblies, etc. The covering of the invention may also be fitted within a pocket formed with a backpack so that it may be deployed therefrom in accordance with the invention. In this instance, the covering may be attached to the backpack with a flap or with one or more straps.

Accordingly, any such changes and modifications to one or more of the embodiments herein chosen for purposes of illustration are intended to be included within the scope of the invention as assessed only by a fair interpretation of the ensuing claims.

Having fully described the invention in such clear and concise terms as to enable those skilled in the art to understand and practice the same, the invention claimed is:

What is claimed is:

1. Apparatus comprising a backpack engagable so as to be worn, an attached covering having load-bearing armor and mounted for movement between a stored condition of the armor toward the backpack and a deployed condition of the armor away from and opposing the backpack, an engagement element carried by one of the backpack and the covering and a complemental engagement element carried by the other of the backpack and the covering, the engagement element mounted to the complemental engagement element for reciprocal movement between a first position corresponding to the stored condition of the armor and a second position corresponding to the deployed condition of the armor.

2. Apparatus of claim 1, wherein the backpack includes a substantial body shell having upper and lower extremities and opposing side extremities and opposing shoulder straps having upper ends attached proximate the upper extremity of the shell and lower ends attached proximate the lower extremity of the shell.

3. Apparatus of claim 2, wherein the covering is further mounted for movement between the stored and deployed conditions of the armor in opposition to the upper extremity of the shell.

4. Apparatus of claim 2, wherein the covering is further mounted for movement between the stored and deployed conditions of the armor in opposition to one of the side extremities of the shell.

5. Apparatus of claim 1, wherein the covering further includes handles that are constructed and arranged so as to be substantially exposed in the stored condition of the armor.

6. Apparatus comprising a backpack engagable so as to be worn and having a back-facing portion, an attached covering having load-bearing armor and mounted for movement between a stored condition of the armor overlying the back-facing portion and a deployed condition of the armor extending away from and opposing the back-facing portion, an engagement element carried by one of the back-facing portion and the covering and a complemental engagement element carried by the other of the back-facing portion and the covering, wherein the engagement element is mounted to the complemental engagement element for reciprocal movement between a first position corresponding to the stored condition of the armor and a second position corresponding to the deployed condition of the armor.

7. Apparatus of claim 6, wherein the covering further includes handles that are constructed and arranged so as to be substantially exposed in the stored condition of the armor.

8. Apparatus of claim 6, further including opposing shoulder straps having upper ends attached proximate an upper extremity of the backpack and lower ends attached proximate a lower extremity of the backpack.

9. Apparatus of claim 8, wherein the covering is further mounted for movement between the stored and deployed conditions of the armor in opposition to the upper extremity of the shell.

10. Apparatus of claim 8, wherein the covering is further mounted for movement between the stored and deployed conditions of the armor in opposition to one of the side extremities of the shell.

11. In a backpack engagable so as to be worn, apparatus comprising:

a load-bearing base engagable to the backpack;

a covering having load-bearing armor and mounted to the base for movement between a stored condition of the armor toward the base and a deployed condition of the armor away from and opposing the base;

an engagement element carried by one of the base and the covering; and a complemental engagement element carried by the other of the base and the covering, wherein the engagement element is mounted to the complemental engagement element for reciprocal movement between a first position corresponding to the stored condition of the armor and a second position corresponding to the deployed condition of the armor.

12. Apparatus of claim 11, the backpack having upper and lower extremities, wherein the base is further engagable to the backpack for permitting movement of the covering between the stored and deployed condition of the armor in opposition to the upper extremity.

13. Apparatus of claim 11, the backpack having opposing side extremities, wherein the base is further engagable to the backpack for permitting movement of the covering between the stored and deployed condition of the armor in opposition to one of the side extremities.

14. Apparatus of claim 11, wherein the covering further includes handles that are constructed and arranged so as to be substantially exposed in the stored condition of the armor.

15. In a backpack engagable so as to be worn and having a back-facing portion, apparatus comprising:

a base adapted and arranged to be mounted to the back-facing portion;

a covering having load-bearing armor and mounted to the base for movement between a stored condition of the armor toward the base and a deployed condition of the armor away from and opposing the base;

an engagement element carried by one of the base and the covering; and a complemental engagement element carried by the other of the base and the covering, wherein the engagement element is mounted to the complemental engagement element for reciprocal movement between a first position corresponding to the stored condition of the armor and a second position corresponding to the deployed condition of the armor.

16. Apparatus of claim 15, the backpack having upper and lower extremities, wherein the base is further engagable to the backpack for permitting movement of the covering between the stored and deployed condition of the armor in opposition to the upper extremity.

17. Apparatus of claim 15, the backpack having opposing side extremities, wherein the base is further engagable to the backpack for permitting movement of the covering between the stored and deployed condition of the armor in opposition to one of the side extremities.

18. Apparatus of claim 15, wherein the covering further includes handles that are constructed and arranged so as to be substantially exposed in the stored condition of the armor.

19. In a backpack engagable so as to be worn, apparatus comprising:

an engagement element engagable to the backpack;

a covering having load-bearing armor; and a complemental engagement element carried by the covering and engagable to the engagement element for reciprocal movement between a stored condition of the armor toward the base and a deployed condition of the armor away from and opposing the base.

20. Apparatus of claim 19, the backpack having upper and lower extremities, wherein the engagement element is further engagable to the backpack for permitting movement of the covering between the stored and deployed condition of the armor in opposition to the upper extremity of the backpack.

21. Apparatus of claim 19, the backpack having opposing side extremities, wherein the engagement element is further engagable to the backpack for permitting movement of the covering between the stored and deployed condition of the armor in opposition to one of the side extremities.

22. Apparatus of claim 19, wherein the covering further includes handles that are constructed and arranged so as to be substantially exposed in the stored condition of the covering.

* * * * *